US010308400B2

(12) United States Patent
Edie et al.

(10) Patent No.: US 10,308,400 B2
(45) Date of Patent: Jun. 4, 2019

(54) CLOSURE FOR A PACKAGE

(71) Applicant: Closure Systems International Inc., Lake Forest, IL (US)

(72) Inventors: John C. Edie, Linden, IN (US); William A. Moll, Bloomingdale, IN (US); Jamison D. Woodley, Indianapolis, IN (US)

(73) Assignee: Closure Systems International Inc., Memphis, TN (US)

( * ) Notice: Subject to any disclaimer, the term of this patent is extended or adjusted under 35 U.S.C. 154(b) by 38 days.

(21) Appl. No.: 15/644,025

(22) Filed: Jul. 7, 2017

(65) Prior Publication Data

US 2019/0009953 A1 Jan. 10, 2019

(51) Int. Cl.
*B65D 41/34* (2006.01)
*B65D 1/02* (2006.01)

(52) U.S. Cl.
CPC ..... *B65D 41/3447* (2013.01); *B65D 1/0246* (2013.01)

(58) Field of Classification Search
CPC ..... B65D 41/32–41/3447; B65D 1/02–1/0246
USPC ... 215/44, 47, 250, 233, 270, 316, 341, 346, 215/272
See application file for complete search history.

(56) References Cited

U.S. PATENT DOCUMENTS

| | | | | |
|---|---|---|---|---|
| 4,664,280 | A * | 5/1987 | Whitney | B65D 41/3423 215/350 |
| 5,259,522 | A * | 11/1993 | Morton | B65D 41/0428 215/252 |
| 5,673,809 | A | 10/1997 | Ohmi | |
| 5,769,255 | A * | 6/1998 | Ohmi | B29C 70/80 215/341 |
| 6,382,445 | B1 | 5/2002 | McCandless | |
| 6,981,603 | B1 * | 1/2006 | Mengeu | B65D 41/0414 215/329 |
| 7,637,384 | B2 | 12/2009 | Price | |
| 8,281,945 | B2 * | 10/2012 | Roussy | B65D 41/0428 215/333 |
| 8,807,360 | B2 | 8/2014 | Erspamer | |
| 9,199,769 | B2 | 12/2015 | Wood | |
| 9,289,926 | B2 | 3/2016 | Stonebraker | |
| 2002/0166859 | A1 | 11/2002 | McGrew, Jr. | |
| 2005/0006334 | A1 | 1/2005 | Luker | |
| 2009/0159555 | A1 | 6/2009 | Druitt | |

(Continued)

*Primary Examiner* — Kareen K Thomas
(74) *Attorney, Agent, or Firm* — Nixon Peabody LLP

(57) ABSTRACT

A closure includes a polymeric top wall portion, a polymeric annular skirt portion, a polymeric continuous plug seal and a polymeric top seal. The annular skirt portion depends from the polymeric top wall portion. The annular skirt portion includes an internal thread formation for mating engagement with an external thread formation of a container. The polymeric annular skirt portion includes an interior surface and an exterior surface. The plug seal depends from the polymeric top wall portion. The continuous plug seal is spaced from the interior surface of the polymeric annular skirt portion. The top seal includes sealing gussets integrally connected thereto. The top seal and the sealing gussets depend from the polymeric top wall portion. The top seal and sealing gussets are located between and spaced from the plug seal and the annular skirt portion.

26 Claims, 6 Drawing Sheets

(56) References Cited

U.S. PATENT DOCUMENTS

| | | | | |
|---|---|---|---|---|
| 2014/0021157 | A1 | 1/2014 | Gren | |
| 2018/0186520 | A1* | 7/2018 | Smith | B65D 41/325 |

* cited by examiner

CLOSURE FOR A PACKAGE

FIELD OF THE INVENTION

The present invention relates generally to a polymeric closure for a package. More specifically, the present invention relates to a polymeric closure that is especially desirable for a short height finish of a container.

BACKGROUND OF THE INVENTION

In designing closures, there are situations where the overall height required for a closure design is different from the existing processing equipment and/or a customer requirement. For example, some customers desire to apply closures using the same equipment (chuck), which can cause issues especially in situations where a solid chuck is used that will not allow flexibility in the height of the closure. These situations may also be present using other types of chucks (e.g., pneumatic chucks or spring-loaded chucks) depending on the height differences. Even if the closures can fit diametrically in the same chuck, the height differences of the closures can cause other cascading equipment issues downstream that will need to overcome the height differences each time the height closure is changed. By using the same equipment without modifications, this can potentially avoid or minimize costly shutdowns or changes over time to the equipment.

If more height is required by a customer than is actually needed from a product performance standpoint, then it is typically added across the entire top panel. When this occurs, however, the weight of the closure can be significantly increased. Having a closure with additional height can also lead to potential warpage when the closure is ejected from a mold.

It would be desirable to provide a closure for a short height finish of a container, while providing sufficient surface area and added height for gripability as compared to a short height closure. It would also be desirable to have a closure that is lighter weight, while still maintaining other desirable properties such as having a desirable seal with the container under different load conditions.

SUMMARY

According to one embodiment, a closure comprises a polymeric top wall portion, a polymeric annular skirt portion, a polymeric continuous plug seal, and a polymeric top seal. The polymeric annular skirt portion depends from the polymeric top wall portion. The annular skirt portion includes an internal thread formation for mating engagement with an external thread formation of a container. The polymeric annular skirt portion includes an interior surface and an exterior surface. The polymeric continuous plug seal depends from the polymeric top wall portion. The continuous plug seal is spaced from the interior surface of the polymeric annular skirt portion. The polymeric top seal includes a plurality of sealing gussets integrally connected thereto. The top seal and the plurality of sealing gussets depend from the polymeric top wall portion. The top seal and plurality of sealing gussets are located between and spaced from the continuous plug seal and the polymeric annular skirt portion.

According to one embodiment, a package includes a container and a closure. The container has a neck portion defining an opening. The container has an external thread formation on the neck portion. The closure is configured for fitment to the neck portion of the container for closing the opening. The closure comprises a polymeric top wall portion, a polymeric annular skirt portion, a polymeric continuous plug seal, and a polymeric top seal. The polymeric annular skirt portion depends from the polymeric top wall portion. The annular skirt portion includes an internal thread formation for mating engagement with an external thread formation of the container. The polymeric annular skirt portion includes an interior surface and an exterior surface. The polymeric continuous plug seal depends from the polymeric top wall portion. The continuous plug seal is spaced from the interior surface of the polymeric annular skirt portion. The polymeric top seal includes a plurality of sealing gussets integrally connected thereto. The top seal and the plurality of sealing gussets depend from the polymeric top wall portion. The top seal and plurality of sealing gussets are located between and spaced from the continuous plug seal and the polymeric annular skirt portion.

According to another embodiment, a closure comprises a polymeric top wall portion, a polymeric annular skirt portion, a polymeric continuous plug seal, a polymeric top seal, and a polymeric tamper-evident band. The polymeric annular skirt portion depends from the polymeric top wall portion. The annular skirt portion includes an internal thread formation for mating engagement with an external thread formation of a container. The polymeric annular skirt portion includes an interior surface and an exterior surface. The polymeric continuous plug seal depends from the polymeric top wall portion. The continuous plug seal is spaced from the interior surface of the polymeric annular skirt portion. The continuous polymeric top seal includes a plurality of sealing gussets integrally connected thereto. The number of sealing gussets is from about 8 to about 20. The top seal and the plurality of sealing gussets depend from the polymeric top wall portion. The top seal and plurality of sealing gussets are located between and spaced from the continuous plug seal and the polymeric annular skirt portion. The polymeric tamper-evident band depends from and is at least partially detachably connected to the polymeric annular skirt portion by a frangible connection.

According to a further embodiment, a closure comprises a polymeric top wall portion, a polymeric annular skirt portion, a polymeric continuous plug seal, and a polymeric top seal. The polymeric annular skirt portion depends from the polymeric top wall portion. The annular skirt portion includes an internal thread formation for mating engagement with an external thread formation of a container. The polymeric annular skirt portion includes an interior surface and an exterior surface. The polymeric continuous plug seal depends from the polymeric top wall portion. The continuous plug seal is spaced from the interior surface of the polymeric annular skirt portion. The polymeric top seal includes a plurality of sealing gussets integrally connected thereto. The top seal and the plurality of sealing gussets depend from the polymeric top wall portion. The top seal and plurality of sealing gussets are located between and spaced from the continuous plug seal and the polymeric annular skirt portion. The closure has an average maximum load at a 25% load of at least about 55 lbs. at failure when measured using a 10 kN static load cell.

The above summary is not intended to represent each embodiment or every aspect of the present invention. Additional features and benefits of the present invention are apparent from the detailed description and figures set forth below.

BRIEF DESCRIPTION OF THE DRAWINGS

Other advantages of the invention will become apparent upon reading the following detailed description and upon reference to the drawings in which.

Figure 1A:
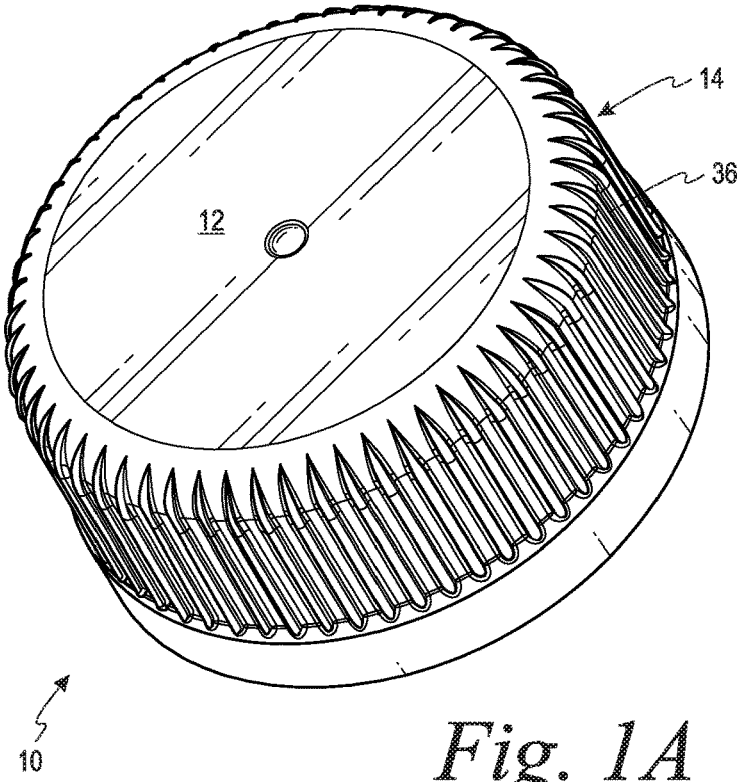
FIG. 1A is a perspective top view of a closure according to one embodiment.

While the invention is susceptible to various modifications and alternative forms, specific embodiments thereof have been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DETAILED DESCRIPTION

Figure 1B:
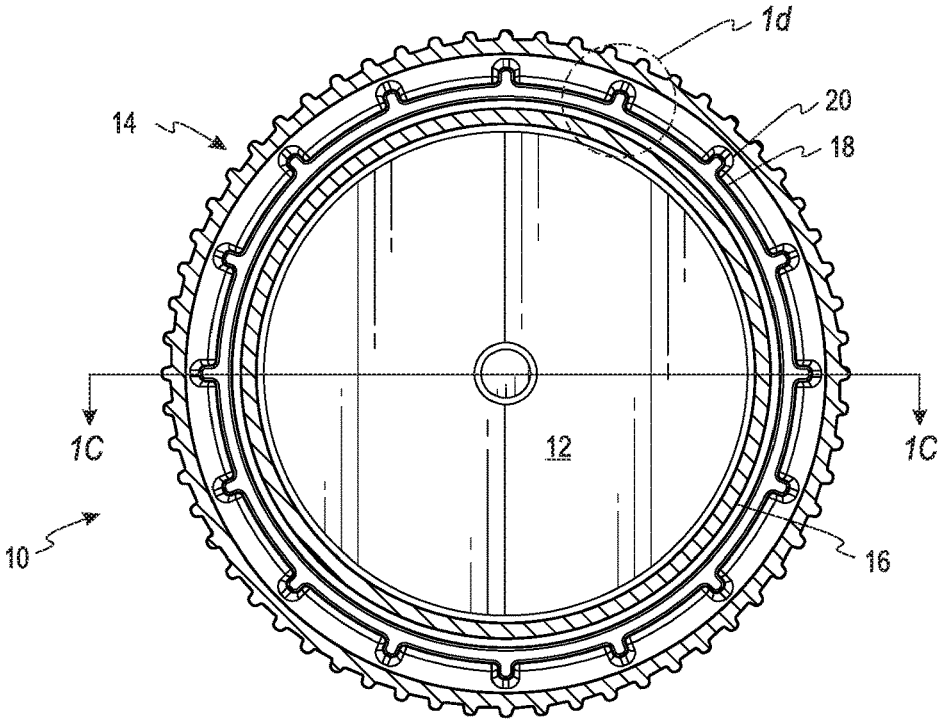
FIG. 1B is a bottom view of the closure of FIG. 1A.
Figure 1C:
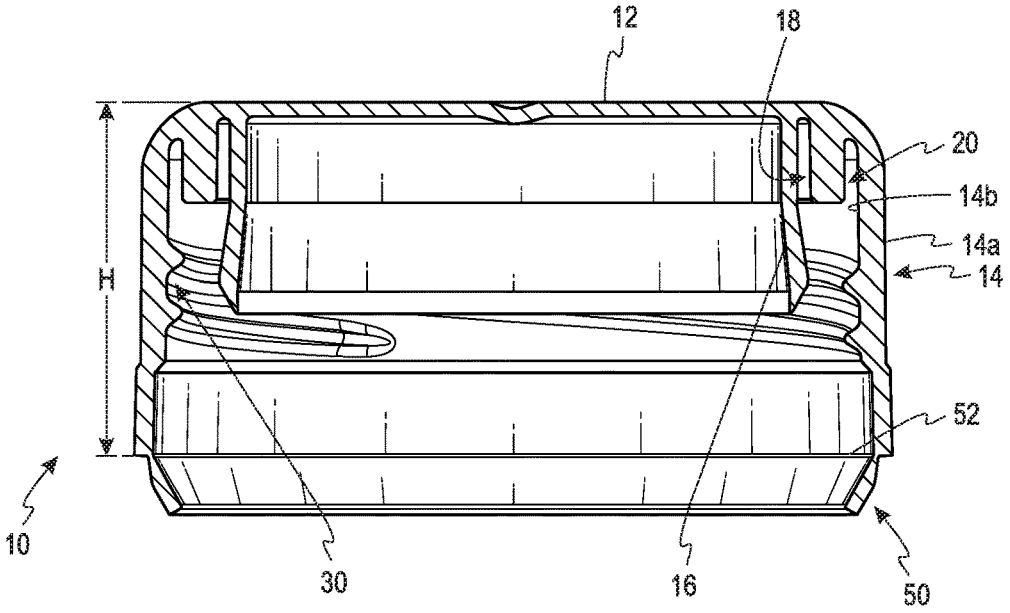
FIG. 1C is a cross-sectional view of the closure of FIG. 1B taken generally along line 1C-1C.

FIGS. 1A-1C illustrate a polymeric closure 10 according to one embodiment of the present invention. The closures are configured to be placed on a container or bottle that contain product. The product is typically a liquid product, but also may be a solid product or a combination of a liquid and solid product. The polymeric closure 10 of FIGS. 1A-1C is a one-piece closure assembly and is a generally cylindrical shape.

Referring still to FIGS. 1A-1C, a polymeric closure 10 includes a polymeric top wall portion 12, a polymeric annular skirt portion 14 that depends from the polymeric top wall portion 12, a polymeric continuous plug seal 16, and a polymeric top seal 18 that includes a plurality of sealing gussets 20. The top wall portion 12 of FIGS. 1A-1C extends across the entire top of the closure without any openings in this embodiment.

Figure 2:
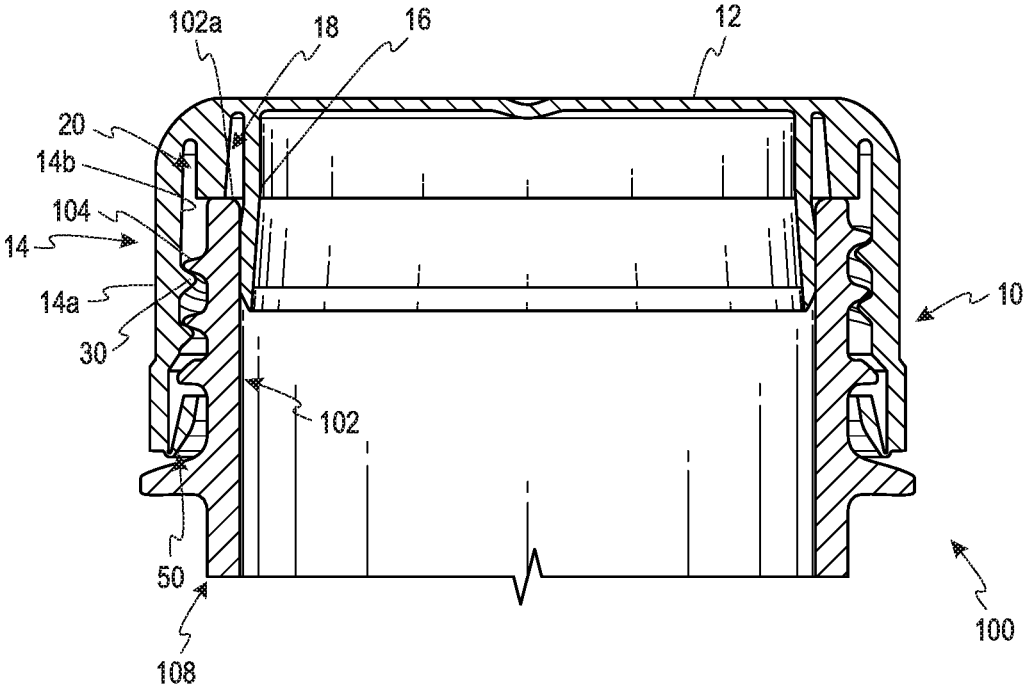
FIG. 2 is a cross-sectional view of the closure of FIGS. 1A-1C in threaded connection with a container according to one embodiment of the invention.

The polymeric annular skirt portion 14 of FIGS. 1B-1C and 2 includes an internal thread formation 30. The polymeric annular skirt portion 14 includes an exterior surface 14*a* and an interior surface 14*b*. The internal thread formation 30 is configured for mating engagement with a corresponding external thread formation of a neck portion of a container. The internal thread formation of the closure may include continuous or discontinuous thread segments, and may include single or multiple leads or threads. Thus, it is contemplated that different thread formations may be used in the closure. One non-limiting example of an internal thread formation is a helical thread formation.

The polymeric continuous plug seal 16 depends from the polymeric top wall portion 12 as shown in FIG. 1C. The continuous plug seal 16 works in conjunction with the finish of the container to form a seal as will be discussed below in conjunction with FIG. 2. The continuous plug seal 16 of FIG. 1C is spaced from and is not directly connected to the polymeric annular skirt portion 14. By being disconnected from the annular skirt portion 14, any impact to the exterior surface 14*a* of the polymeric annular skirt portion 14 will have less risk of being transferred to the finish of the container, which can potentially disturb the seal between the continuous plug seal 16 and the finish. Such a disturbance can cause a loss in product integrity.

The range of interference between the top seal 18 and the finish of the container is generally from about 6 to about 14 mils and, more specifically, from about 8 to about 12 mils. The range of interference between the top seal 18 and the finish of the container is typically from about 10 to about 12 mils. This is shown, for example, in FIG. 2 as the distance in which a bottom surface of the top seal 18 contacts an upper surface 102*a* of a neck portion 102 of a container 108.

Referring back to FIGS. 1A-1C, the top seal 18 includes the plurality of sealing gussets 20 that are integrally connected to each other. The top seal 18 including the plurality of gussets 20 depends from the top wall portion 12. The top seal 18 is shown as being continuous in FIGS. 1B and 1*s* in the form of a generally circular ring. Both the top seal 18 and the plurality of gussets 20 are spaced from and located between the continuous plug seal 16 and the polymeric annular skirt portion 14. Thus, the top seal 18 and the plurality of gussets 20 do not extend radially in such a manner to contact the polymeric annular skirt portion 14. By having the top seal 18 including the plurality of sealing gussets 20 being disconnected from the annular skirt portion 14, there is a reduced risk to disturbing the top seal 18 when there is an impact to the exterior surface 14*a* of the annular skirt portion 14. This assists in reducing or eliminating a potential sealing problem that can led to a loss of product integrity.

The top seal 18 including the plurality of gussets 20 assists in providing a positive stop when the finish of the container and the closure are being threaded with each other. Thus, the top seal 18 and the plurality of gussets 20 assist in positioning the finish of the container when the closure is being threaded onto the finish. By properly positioning the finish of the container, this assists in avoiding a high removal torque and other potential capping defects. Specifically, the plurality of gussets 20 assists in mitigating the risk of overapplying and stripping the threads, or by losing proper sealing contact when the finish of the container extends closer to the top wall portion 12.

The top seal 18 including the plurality of gussets 20 is designed to add height in selected areas to lengthen the closure 10, which assists in providing gripability to the user. The top seal 18 and the plurality of gussets 20 lengthen the closure 10 without significantly increasing the weight of the closure.

The plurality of sealing gussets 20 also adds support and a strengthening structure to the closure 10. More specifically, the plurality of gussets 20 assists in preventing or inhibiting the top seal 18 from flexing, which could lead to a sealing problem between the top seal 18 and the finish.

The number of sealing gussets can vary in the closure. The number of sealing gussets is generally from about 3 to about 24 and, more specifically, from about 8 to about 20 in the closure. The number of sealing gussets is typically from about 14 to about 18 in the closure.

The sealing gussets 20 are typically spaced in constant intervals that are spaced inwardly from the circumference of the closure 10. It is contemplated that the sealing gussets may be spaced in different intervals that are spaced inwardly from the circumference of the closure.

Figure 1D:
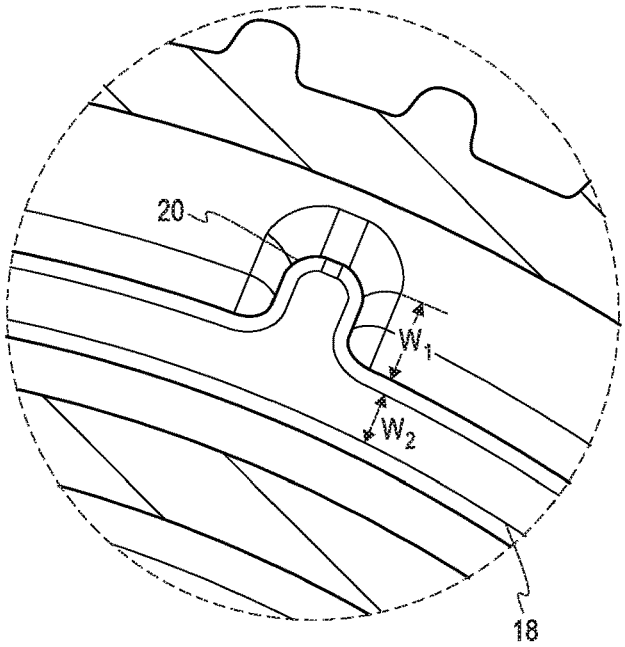
FIG. 1D is an enlarged view of generally circular area 1D in FIG. 1B.

The thickness W1 of the plurality of sealing gussets 20 of FIG. 1D is generally from about 15 to about 40 mils and, more specifically, from about 20 to 30 mils. The thickness W2 of the top seal 18 of FIG. 1D is generally from about 15 to about 40 mils and, more specifically, from about 20 to 30 mils.

The combination of the top plug seal 18 and the plurality of gussets 20 form an extended seal of the closure 10. The extended seal of the closure includes any geometry that extends downward from the polymeric top wall portion and contacts the finish of the container, while being spaced from the annular skirt portion 14. The extended seal typically forms a physical, hermetic seal with the finish of the container. In another embodiment, the extended seal contacts the finish of the container, but does not form a physical, hermetic seal.

The extended seal (top plug seal 18 including the plurality of gussets 20) is typically continuous to create a top seal. It is contemplated that the extended seal may be discontinuous when only a positive top stop is needed.

The closure 10 as shown in FIG. 1A includes a plurality of knurls 36 formed on the annular skirt portion 14. The plurality of knurls 36 assists the user in gripping the closure during the opening and closing of the closure from the container. The plurality of knurls 36 also provides additional strength and support to the closure itself. It is contemplated that the number and shape of the knurls, if used, may be different than depicted in FIG. 1A.

The closure of the present invention in one embodiment generally has an overall height H as shown in FIG. 1C of from about 0.4 to about 0.6 inch. The overall height H is typically from about 0.45 to about 0.6 inch and, more specifically, from about 0.5 inch to about 0.55 inch.

The closure may also include a polymeric tamper-evident feature. For example, the closure 10 includes a polymeric tamper-evident band 50 (FIG. 1C) located at the bottom thereof (i.e., an end opposite of the polymeric top wall portion 12). The tamper-evident band 50 depends from and is at least partially detachably connected to the polymeric annular skirt portion 14 by a frangible connection 52. The tamper-evident band 50 works in conjunction with the container to indicate to a user that the contents of the container may have been accessed. More specifically, the tamper-evident band 50 is designed to separate from the polymeric annular skirt portion 14 if a user starts to open the package and gain access to the container.

The polymeric tamper-evident band may be formed by molded-in-bridges in one embodiment. The molded-in-bridges are typically formed using a feature in the mold. In another embodiment, the polymeric tamper-evident band may be formed using scoring or scored lines, notches, leaders, or other lines of weaknesses.

The tamper-evident band 50 is in a reversed orientation in FIG. 1C. This is a common orientation when the closure is removed from a mold and allows the closure to be ejected more easily from the closure-forming tooling. The tamper-evident band is later folded from the reversed orientation into a functional orientation, which is shown and discussed below with respect to FIG. 2.

The closures of the present invention generally have an average maximum load at a 75% load coverage of at least about 70 lbs. at failure when measured using a 10 kN static load cell. The closures of the present invention desirably have an average maximum load at a 75% load coverage of at least about 80 lbs. at failure or at least about 90 lbs. at failure when measured using a 10 kN static load cell. The closures of the present invention even more desirably have an average maximum load at a 75% load coverage of at least about 100 lbs. at failure when measured using a 10 kN static load cell.

The closures of the present invention generally have an average maximum load at a 50% load coverage of at least about 60 lbs. at failure when measured using a 10 kN static load cell. The closures of the present invention desirably have an average maximum load at a 50% load coverage of at least about 70 lbs. at failure or at least about 75 lbs. at failure when measured using a 10 kN static load cell. The closures of the present invention even more desirably have an average maximum load at a 50% load coverage of at least about 80 lbs. at failure when measured using a 10 kN static load cell.

The closures of the present invention generally have an average maximum load at a 25% load coverage of at least about 50 lbs. at failure when measured using a 10 kN static load cell. The closures of the present invention desirably have an average maximum load at a 25% load coverage of at least about 55 lbs. at failure or at least about 60 lbs. at failure when measured using a 10 kN static load cell. The closures of the present invention even more desirably have an average maximum load at a 25% load coverage of at least about 65 lbs. at failure or at least 70 lbs. at failure when measured using a 10 kN static load cell.

The closure 10 including the top wall portion 12, the annular skirt portion 14, the continuous plug seal 16, the top seal 18 including the gussets 20 are made of polymeric material. The closure 10 typically comprises high density polyethylene (HDPE), polypropylene (PP), or blends thereof. It is contemplated that the closure may be made of other polymeric materials. The tamper-evident band 50, if present, is typically made of the same materials as the rest of the closure.

The closures are typically formed by processes such as injection or compression molding. It is contemplated that other processes may be used in forming the closures.

The closures of the present invention, including closure 10, may be used with the container 108 to form a package 100 of FIG. 2. A portion of the container 108 is shown in FIG. 2 and includes the neck portion 102 that defines an opening. The neck portion 102 of the container 108 includes an external thread formation 104. The external thread formation 104 of the container 108 engages with the corresponding internal thread formation 30 of the closure 10 to seal the package 100. The external thread formation of the container may include continuous or discontinuous thread segments, and may include single or multiple threads. Thus, it is contemplated that different threads formations may be used in the container. One non-limiting example of an external thread formation of the container is a helical thread formation.

The container 108 is typically made of polymeric material. One non-limiting example of a material to be used in forming a polymeric container is polyethylene terephthalate (PET), polypropylene (PP) or blends using the same. It is contemplated that the container may be formed of other polymeric materials. It is also contemplated that the container may be formed of glass. The container 108 may have an encapsulated oxygen-barrier layer or oxygen barrier material incorporated therein.

To open the container 108 and gain access to the product therein, the closure 10 is unthreaded by turning the closure 10 with respect to the container 108. The tamper-evident band 50 is in its functional orientation in FIG. 2. The container surface naturally separates from the closure as the closure is unthreaded. After the closure has been unthreaded, the closure 10 is then removed from the container so that the user can gain access to the container. During this process, the tamper-evident band 50 is separated from the remainder of the closure 10. The tamper-evident band 50 is held in place and allows the frangible connection to separate the tamper-evident band from the remainder of the closure. The tamper-evident band 50 desirably remains with the container, but it is contemplated that the tamper-evident band may be removed in a separate step from the container.

The closures are designed to fit onto a short height finish of a container, while providing surface area and added height for gripability as compared to other short height closures. This added height allows for interchangeability during the processing using standard height closures and finishes without the need to convert capping equipment, resulting in less downtime during a changeover from standard to short height finishes. The extended seal allows the height of the closure to be adjusted to address customer's needs without significantly increasing the weight of the closure, cycle time or negatively impacting the quality of the closure.

It is contemplated that other shaped gussets may be used other than those depicted in FIG. 1B such as depicted in FIGS. 3A-4B.

Figure 3A:
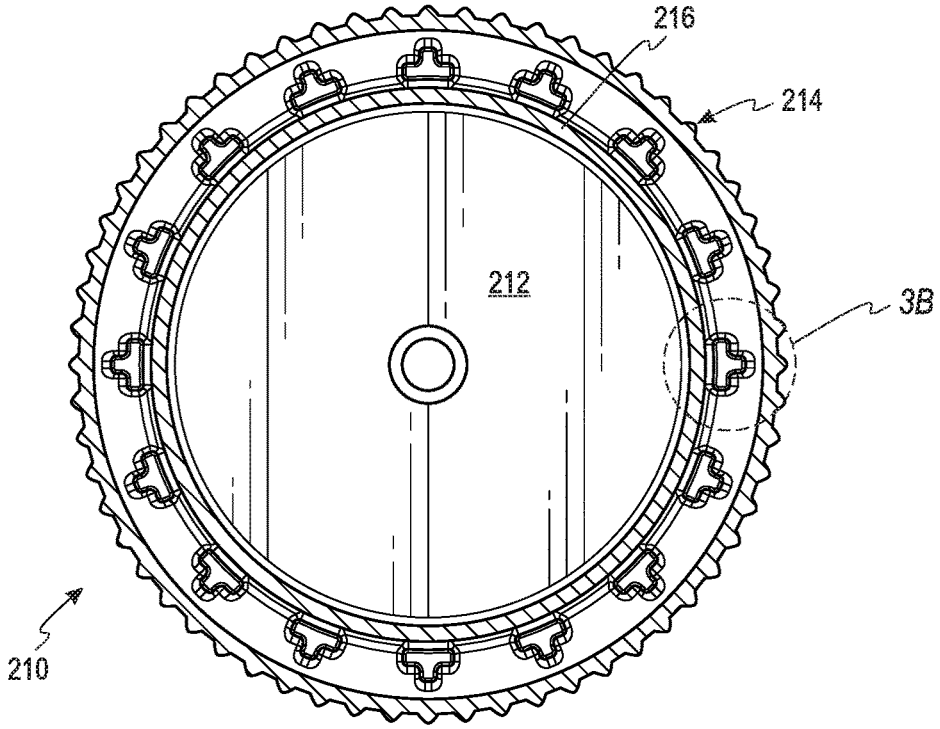
FIG. 3A is a bottom view of a closure according to another embodiment.
Figure 3B:
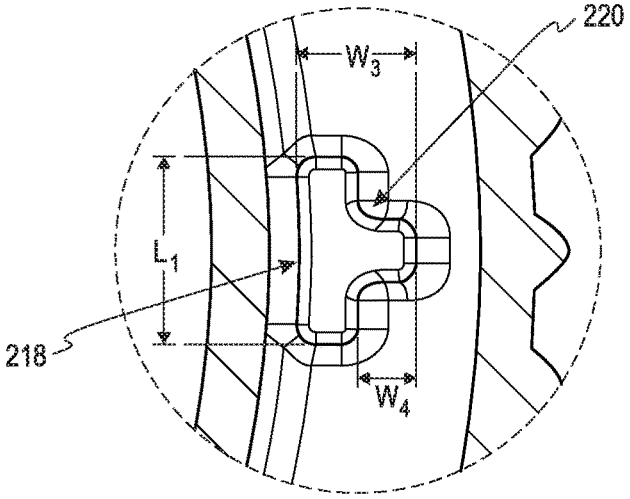
FIG. 3B is an enlarged view of generally circular area 3B in FIG. 3A.

Referring to FIGS. 3A and 3B, a bottom view of a closure 210 is shown according to another embodiment. The closure 210 includes a polymeric top wall portion 212 (interior surface shown), a polymeric annular skirt portion 214 that depends from the top wall portion 212, a continuous plug seal 216, and a plurality of polymeric top seals 218 that includes a plurality of sealing gussets 220. Each of the top seals 218 includes a respective one of the sealing gussets 220. The top wall portion 212, the polymeric annular skirt portion 214, and the continuous plug seal 216 are similar to and function the same as the top wall portion 12, the annular skirt portion 14 and the continuous plug seal 16, respectively.

The polymeric top seals 218 including a plurality of gussets 220 are shown as being discrete and discontinuous. The top seals 218 and the plurality of gussets 220 function as a positive top stop. This assists in properly positioning the finish of the container, which assists in avoiding a high removal torque and other potential capping defects. The polymeric top seals 218 including the plurality of gussets 220 are in a general "T" shape. This is shown in greater detail in FIG. 3B. The length L1 of the top seals 218 is generally from about 50 to about 100 mils and, more specifically, from about 65 to about 90 mils. The width W3 of the top seals 218 including the gussets 220 is generally from about 25 to about 75 mils and, more specifically, from about 35 to about 60 mils. The width W4 of the gussets 220 is generally from about 15 to about 40 mils and, more specifically, from about 20 to about 30 mils.

Figure 4A:
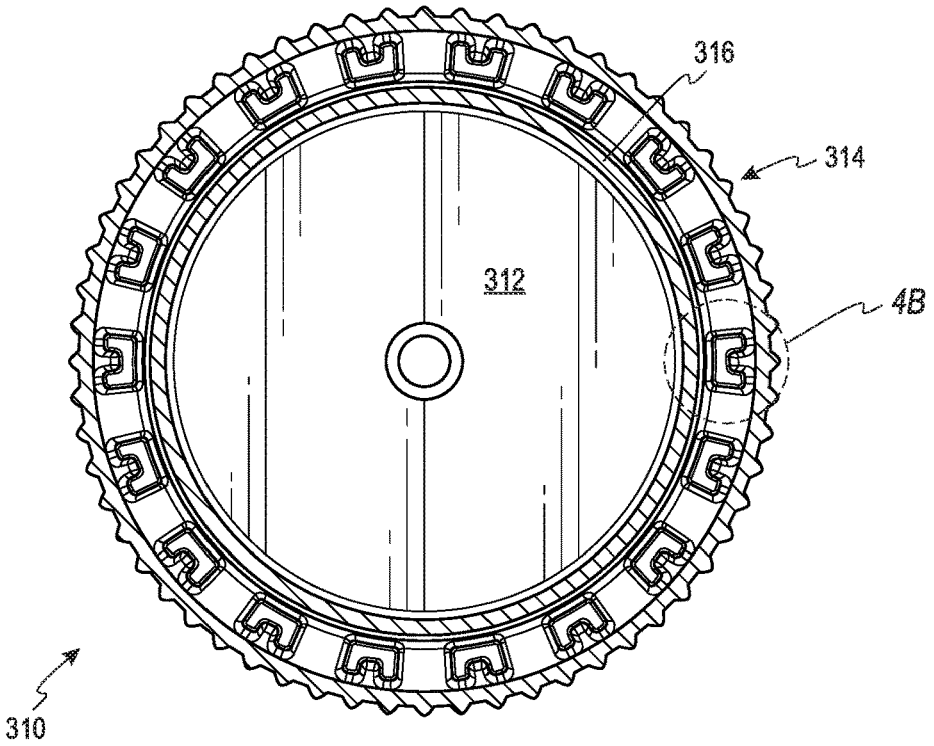
FIG. 4A is a bottom view of a closure according to a further embodiment.
Figure 4B:
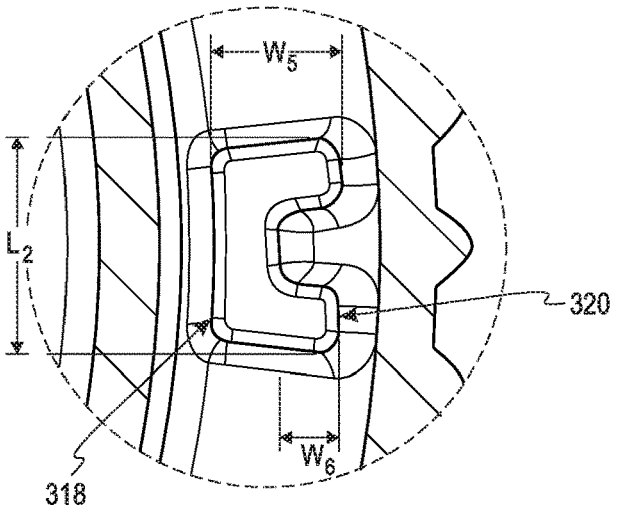
FIG. 4B is an enlarged view of generally circular area 4B in FIG. 4A.

Referring to FIGS. 4A and 4B, a bottom view of a closure 310 is shown according to another embodiment. The closure 310 includes a polymeric top wall portion 312 (interior surface shown), a polymeric annular skirt portion 314 that depends from the top wall portion 312, a continuous plug seal 316, and a plurality of polymeric top seals 318 that includes a plurality of sealing gussets 320. Each of the top seals 318 includes a respective one of the sealing gussets 320. The top wall portion 312, the polymeric annular skirt portion 314, and the continuous plug seal 316 are similar to and function the same as the top wall portion 12, annular skirt portion 14 and the continuous plug seal 16, respectively.

The polymeric top seals 318 including a plurality of gussets 320 are shown as being discrete and discontinuous. The top seals 318 and the plurality of gussets 320 function in a similar manner as the top seals 218 and the plurality of gussets 220. The polymeric top seals 318 including a plurality of gussets 320 are in a general "U" shape. This is shown in greater detail in FIG. 4B. The length L2 of the tope seals 318 is generally from about 50 to about 100 mils and, more specifically, from about 65 to about 90 mils. The width W5 of the top seals including the gussets 320 is generally from about 25 to about 75 mils and, more specifically, from about 35 to about 60 mils. The width W6 of the gussets 320 is generally from about 15 to about 40 mils and, more specifically, from about 20 to about 30 mils.

It is contemplated that the discrete top seals and gussets of FIGS. 3A and 4B may be formed in other shapes including, but not limited to a generally "V" shape.

Figure 5A:
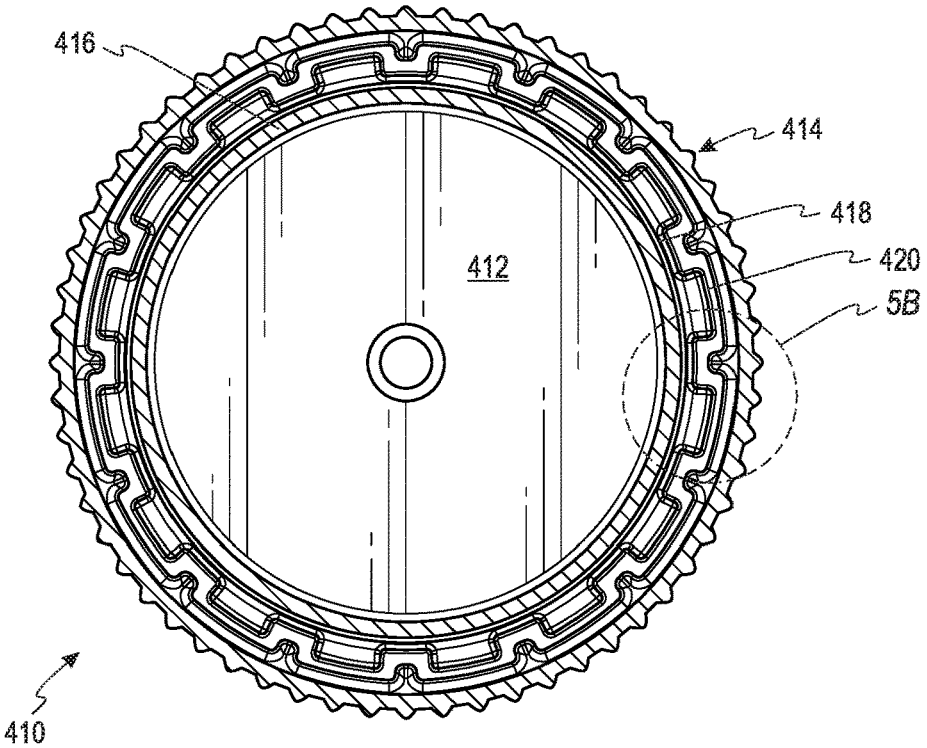
FIG. 5A is a bottom view of a closure according to yet another embodiment.
Figure 5B:
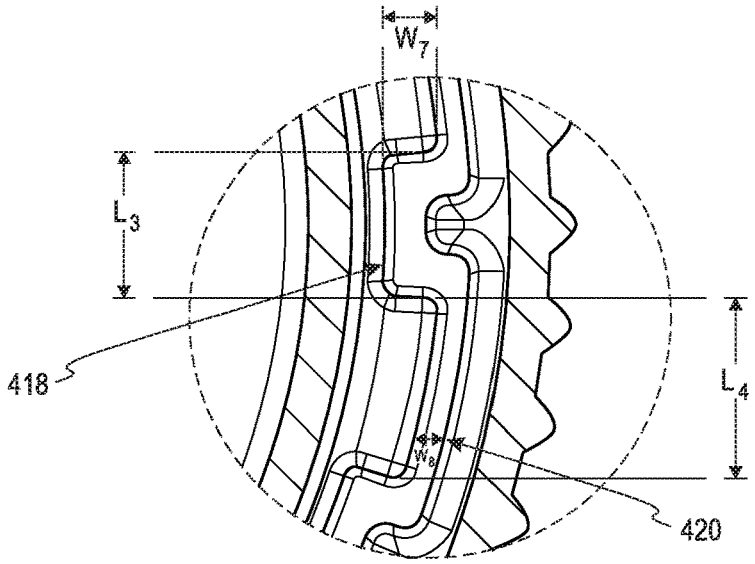
FIG. 5B is an enlarged view of generally circular area 5B in FIG. 5A.

Referring to FIGS. 5A and 5B, a bottom view of a closure 410 is shown. The closure 410 includes a polymeric top wall portion 412 (interior surface shown), a polymeric annular skirt portion 414 that depends from the top wall portion 412, a continuous plug seal 416, polymeric top seals 418 and supporting walls 420. The top wall portion 412, the polymeric annular skirt portion 414, and the continuous plug seal 416 are similar to and function the same as the top wall portion 12, the annular skirt portion 14 and the continuous plug seal 16, respectively.

The combination of the polymeric top seals 418 and the supporting walls 420 is continuous and extends inwardly of the circumference of the closure as shown in FIG. 5A. The top seals 418 and supporting walls 420 are in an alternating inner and outer pattern in which each top seal 418 extends a length L3 and each supporting wall 420 extends a length L4. The length L3 of each top seal 418 is generally from about 50 to about 100 mils and, more specifically, from about 60 to about 80 mils. The length L4 of each supporting wall 420 is generally from about 50 to about 150 mils and, more specifically, from about 75 to about 125 mils.

The supporting walls 420 perform the same function as the gussets discussed above (i.e., providing stiffness to the top seal 218). The thickness W7 of the top seal 418 is generally from about 15 to about 40 mils and, more specifically, from about 20 to about 30 mils. The thickness W8 of the supporting wall 420 is generally from about 15 to about 40 mils and, more specifically, from about 20 to about 30 mils.

In this embodiment, the closure comprises a polymeric top wall portion, a polymeric annular skirt portion, a polymeric continuous plug seal, polymeric top seals and polymeric supporting walls. The polymeric annular skirt portion depends from the polymeric top wall portion. The annular skirt portion includes an internal thread formation for mating engagement with an external thread formation of a container. The polymeric annular skirt portion includes an interior surface and an exterior surface. The polymeric continuous plug seal depends from the polymeric top wall portion. The continuous plug seal is spaced from the interior surface of the polymeric annular skirt portion. The polymeric top seals are integrally connected to the supporting walls. The top seal and the supporting walls depend from the polymeric top wall portion. The top seal and supporting walls are located between and spaced from the continuous plug seal and the polymeric annular skirt portion. The combination of the top seals and the supporting walls is continuous and is formed in an alternating inner and outer pattern. It is desirable for the width of the top seals to be greater than the width of the supporting walls.

The closures 210, 310 and 410 may be used with container 108 in the same manner as described above with respect to closure 10.

The polymeric closures formed by the processes of the present invention are desirable in both low-temperature and high-temperature applications. The polymeric closures formed by the processes of the present invention may be used in low-temperature applications such as an ambient or a cold fill. These applications include water, sports drinks, aseptic applications such as dairy products, and pressurized products such as carbonated soft drinks. It is contemplated that other low-temperature applications may be used with the polymeric closures formed by the processes of the present invention.

The polymeric closures formed by the processes of the present invention may be exposed to high-temperature applications such as hot-fill, pasteurization, and retort applications. A hot fill application is generally performed at temperatures around 185° F., while a hot-fill with pasteurization is generally performed at temperatures around 205° F. Retort applications are typically done at temperatures greater than 250° F. It is contemplated that the polymeric closures of the present invention can be used in other high-temperature applications.

EXAMPLES

Inventive and comparative closures were made and tested. Inventive Closure 1 was substantially similar to that shown in FIGS. 1A-1D. The Inventive Closure 1 was a one-piece configuration made of high density polyethylene (HDPE).

Comparative Closure 1 was an Aqua-Lok mini 26 mm TC made by Closure Systems International. Comparative Closure 1 was a one-piece closure assembly made of HDPE.

Comparative Closure 2 was a Tall Savalas closure (26 mm) made by Novembal. Comparative Closure 2 was a one-piece closure assembly made of HDPE.

A total of 48 samples of each configuration (Inventive Closure 1 and Comparative Closures 1 and 2) was tested. More specifically, 12 samples of each closure were tested at each of the four load configurations, which will be discussed below.

Each of Inventive Closure 1 and the Comparative Closures 1 and 2 was tested in combination with a container or bottle. Thus, a package included one of three different types of closures and the container. The containers were identical and made of PET with 8 fluid ounces of water. The containers were identified as ISBT 969-1914-000 and each had a 26 mm finish. Each of the closures was threaded onto the finish of the respective containers into a closed position. The testing conditions and the results are shown in the Table below.

Different loads were placed on each of the closures and were measured by an Instron 5566 with a 10 kN static load cell. Four different coverage loads were tested—100%, 75%, 50% and 25% until failure occurred. Failure was determined by whether the contents (water) of the container leaked from a seal failure ("leak") or whether the container or bottle itself collapsed ("bottle"). The maximum load (in lbs.) at failure was measured using the Instron 5566 device for each of samples at the four different loads with each of the closures. The average of the measured maximum loads for the four different loads for each of the closures was recorded in the Table below.

The Table

| Species | Load Coverage | Avg. Max Load (lbs.) | Dominant Failure Mode | Pass Rate |
|---|---|---|---|---|
| Comparative | 100% | 100.5 | Bottle | 100% |
| Example 1 | 75% | 71.8 | Leak | 0% |
| (CSI) | 50% | 57.4 | Leak | 0% |
| | 25% | 47.9 | Leak | 0% |
| Comparative | 100% | 101.4 | Bottle | 100% |
| Example 2 | 75% | 76.8 | Leak | 8.3% |
| (Novembal) | 50% | 57.4 | Leak | 0% |
| | 25% | 51.3 | Leak | 0% |
| Inventive | 100% | 105.6 | Bottle | 100% |
| Example 1 | 75% | 108.1 | Bottle | 100% |
| | 50% | 84.1 | Bottle | 100% |
| | 25% | 70.2 | Bottle | 100% |

The testing results showed that Inventive Closure 1 surprisingly had a much higher average maximum load at failure than both Comparative Closures 1 and 2. For example, at a 75% load coverage, the Inventive Closure failed at 108.1 lbs. with the bottle, while Comparative Closure 1 failed at 71.8 lbs. and Comparative Closure 2 failed at 76.8 lbs. by leaking.

Inventive Closure 1 also did not fail by having contents leak from the container or bottle, unlike Comparative Closures 1 and 2 at 75%, 50% and 25% load coverages. A pass rate of 100% indicated that the bottle failed in each of the testing, while a pass rate of 0% indicated that the failure occurred each time by leaking. Thus, Inventive Closure 1 performed much better than both Comparative Closures 1 and 2 in the different levels of load testing.

What is claimed is:

1. A closure comprising:

a polymeric top wall portion;

a polymeric annular skirt portion depending from the polymeric top wall portion, the annular skirt portion including an internal thread formation for mating engagement with an external thread formation of a container, the polymeric annular skirt portion including an interior surface and an exterior surface;

a polymeric continuous plug seal depending from the polymeric top wall portion, the continuous plug seal being spaced from the interior surface of the polymeric annular skirt portion; and a polymeric top seal including a plurality of sealing gussets integrally connected thereto, the top seal and the plurality of sealing gussets depending from the polymeric top wall portion, the top seal and plurality of sealing gussets being located between and spaced from the continuous plug seal and the polymeric annular skirt portion.

2. The closure of claim 1, wherein the closure further includes a polymeric tamper-evident feature.

3. The closure of claim 2, wherein the polymeric tamper-evident feature is a band, the tamper-evident feature depending from and is at least partially detachably connected to the polymeric annular skirt portion by a frangible connection.

4. The closure of claim 1, wherein the internal thread formation of the closure includes at least one helical thread element.

5. The closure of claim 1, wherein the shape of the closure is generally cylindrical.

6. The closure of claim 1, wherein the closure is a one-piece closure.

7. The closure of claim 1, wherein the number of sealing gussets is from 3 to 24.

8. The closure of claim 7, wherein the number of sealing gussets is from 8 to 20.

9. The closure of claim 8, wherein the number of sealing gussets is from 14 to 18.

10. The closure of claim 1, wherein the plurality of sealing gussets is spaced in constant intervals and each of the plurality of sealing gussets is spaced inwardly from the annular skirt portion and located between the polymeric top seal and the annular skirt portion.

11. The closure of claim 1, wherein the polymeric top seal is continuous.

12. The closure of claim 1, wherein the polymeric top seal is continuous and in the form of a generally circular ring.

13. The closure of claim 1, wherein the overall height of the closure is from 0.4 inch to 0.6 inch.

14. A closure comprising:

a polymeric top wall portion;

a polymeric annular skirt portion depending from the polymeric top wall portion, the annular skirt portion including an internal thread formation for mating engagement with an external thread formation of a container, the polymeric annular skirt portion including an interior surface and an exterior surface;

a polymeric continuous plug seal depending from the polymeric top wall portion, the continuous plug seal being spaced from the interior surface of the polymeric annular skirt portion; and a polymeric top seal including a plurality of sealing gussets integrally connected thereto, the top seal and the plurality of sealing gussets depending from the polymeric top wall portion, the top seal and plurality of sealing gussets being located between and spaced from the continuous plug seal and the polymeric annular skirt portion, wherein the polymeric top seal is discontinuous and forms a plurality of polymeric top seals.

15. The closure of claim 14, wherein the combination of each of the plurality of top seals and the plurality of sealing gussets is in the shape of the letter "T".

16. The closure of claim 14, wherein the combination of each of the plurality of top seals and the plurality of sealing gussets is in the shape of the letter "U".

17. A package comprising:

a container having a neck portion defining an opening, the container having an external thread formation on the neck portion; and a closure configured for fitment to the neck portion of the container for closing the opening, the closure comprises a polymeric top wall portion;

a polymeric annular skirt portion depending from the polymeric top wall portion, the annular skirt portion including an internal thread formation for mating engagement with an external thread formation of the container, the polymeric annular skirt portion including an interior surface and an exterior surface;

a polymeric continuous plug seal depending from the polymeric top wall portion, the continuous plug seal being spaced from the interior surface of the polymeric annular skirt portion; and a polymeric top seal including a plurality of sealing gussets integrally connected thereto, the top seal and the plurality of sealing gussets depending from the polymeric top wall portion, the top seal and plurality of sealing gussets being located between and spaced from the continuous plug seal and the polymeric annular skirt portion.

18. The package of claim 17, wherein the polymeric top seal is continuous, the polymeric top seal and the plurality of sealing gussets forming a physical, hermetic seal with the container.

19. The package of claim 17, wherein the polymeric top seal is continuous and is in the form of a generally circular ring.

20. The package of claim 19, wherein the number of sealing gussets is from 8 to 20.

21. A closure comprising:

a polymeric top wall portion;

a polymeric annular skirt portion depending from the polymeric top wall portion, the annular skirt portion including an internal thread formation for mating engagement with an external thread formation of a container, the polymeric annular skirt portion including an interior surface and an exterior surface;

a polymeric continuous plug seal depending from the polymeric top wall portion, the continuous plug seal being spaced from the interior surface of the polymeric annular skirt portion;

a continuous polymeric top seal including a plurality of sealing gussets integrally connected thereto, the number of sealing gussets being from 8 to 20, the top seal and the plurality of sealing gussets depending from the polymeric top wall portion, the top seal and plurality of sealing gussets being located between and spaced from the continuous plug seal and the polymeric annular skirt portion; and a polymeric tamper-evident band, the tamper-evident band depending from and is at least partially detachably connected to the polymeric annular skirt portion by a frangible connection.

22. The closure of claim 21, wherein the continuous polymeric top seal is in the form of a generally circular ring.

23. A closure comprising:

a polymeric top wall portion;

a polymeric annular skirt portion depending from the polymeric top wall portion, the annular skirt portion including an internal thread formation for mating engagement with an external thread formation of a container, the polymeric annular skirt portion including an interior surface and an exterior surface;

a polymeric continuous plug seal depending from the polymeric top wall portion, the continuous plug seal being spaced from the interior surface of the polymeric annular skirt portion; and a polymeric top seal including a plurality of sealing gussets integrally connected thereto, the top seal and the plurality of sealing gussets depending from the polymeric top wall portion, the top seal and plurality of sealing gussets being located between and spaced from the continuous plug seal and the polymeric annular skirt portion, wherein the closure has an average maximum load at a 25% load coverage of at least 55 lbs. at failure when measured using a 10 kN static load cell.

24. The closure of claim 23, wherein the closure has an average maximum load at a 25% load coverage of at least 60 lbs. at failure when measured using a 10 kN static load cell.

25. The closure of claim 24, wherein the closure has an average maximum load at a 25% load coverage of at least 65 lbs. at failure when measured using a 10 kN static load cell.

26. The closure of claim 25, wherein the closure has an average maximum load at a 25% load coverage of at least 70 lbs. at failure when measured using a 10 kN static load cell.

* * * * *